United States Patent [19]

Iwama et al.

[11] Patent Number: 4,977,692

[45] Date of Patent: Dec. 18, 1990

[54] RETENTION DEVICE FOR SKI BOOT

[75] Inventors: Shinichi Iwama; Keiji Tsugami; Shigeto Yamada, all of Tokyo, Japan

[73] Assignee: Daiwa Seiko, Inc., Tokyo, Japan

[21] Appl. No.: 383,401

[22] Filed: Jul. 21, 1989

[30] Foreign Application Priority Data

Aug. 4, 1988 [JP] Japan ..... 63-194926

[51] Int. Cl.[5] ..... A43B 5/04

[52] U.S. Cl. ..... 36/119

[58] Field of Search ..... 36/50, 117, 118, 119, 36/120, 121

[56] References Cited

U.S. PATENT DOCUMENTS

| | | | |
|---|---|---|---|
| 4,192,087 | 3/1980 | Salomon | 36/119 |
| 4,205,467 | 6/1980 | Salomon | 36/119 |
| 4,575,956 | 3/1986 | Paris | 36/119 |
| 4,802,290 | 2/1989 | Marega | 36/119 |
| 4,827,632 | 5/1989 | Legon | 36/119 |

FOREIGN PATENT DOCUMENTS

| | | | |
|---|---|---|---|
| 3236259 | 4/1983 | Fed. Rep. of Germany | 36/119 |
| 2468322 | 11/1979 | France | 36/119 |
| 2547487 | 12/1984 | France | 36/110 |

*Primary Examiner*—Paul T. Sewell
*Assistant Examiner*—Andrew D. Meyers
*Attorney, Agent, or Firm*—Kalish & Gilster

[57] ABSTRACT

The present invention relates to ski boots provided with a foot holding mechanism for pressing to fix the fore part of a foot instep, wherein when an adjusting bolt is turned externally to apply a tensile force to pressing bands, a rocking member is rocked in the axis direction of the pressing bands depending on various foot shapes, thereby applying almost equal tensile force to the pressing bands in a plural number so as to press the fore part of the foot instep evenly.

6 Claims, 7 Drawing Sheets

RETENTION DEVICE FOR SKI BOOT

BACKGROUND OF THE INVENTION

The present invention relates to ski boots, and particularly to ski boots provided with a foot holding mechanism for pressing to fix the fore part of a foot instep.

Recently, ski boots being produced are provided with a foot holding mechanism for pressing to fix the fore part of the foot instep against the outer shell so as to eliminate the so-called play between the ski boot and the foot inserted in the boot, thereby giving a feeling of unity between the foot and the boot.

Such ski boots known include those as disclosed in for example Japanese Patent Application Laid-open Print No. 58-81001.

The ski boots disclosed in the above laid-open print is formed by providing an adjusting bolt at the fore part of the instep of the outer shell to be freely turnable externally, providing between the outer shell and an inner boot a narrow pressing band for connecting a moving member to the adjusting bolt and for pressing the fore part of the foot instep in the width direction of the instep, fixing one end of the pressing band to the outer shell, and connecting the other end to the moving member.

In such ski boots, turning the adjusting bolt externally in one direction applies tensile force to the pressing bands, which presses the fore part of the foot instep downward to fix that fore part of the foot instep against the outer shell, thereby removing the play between the foot and the boot to improve a feeling of unity therebetween and improving the control of skis by using such as the edge.

Since these conventional ski boots use one narrow pressing band to press and fix the fore part of the foot instep against the outer shell, however, a tightening width by the pressing bands is narrow. This may result in causing pain in the foot because the fore part of the instep is partly pressed, and that part can not be fully tightened. Thus they have a drawback that the feeling of unity between the foot and the boot can not be attained sufficiently.

To remedy the above drawbacks, the width of the pressing bands may be widened but, since the foot shapes are different from one to another, one wide pressing band can not sufficiently correspond to every foot shape, and a sufficient tightening can not be obtained.

SUMMARY OF THE INVENTION

An object of the present invention is to provide ski boots which can sufficiently tighten the fore part of the instep depending on various foot shapes.

Another object of the present invention is to provide ski boots capable of sufficiently tightening the fore part of the instep depending on various foot shapes, improving a feeling of unity between the foot and the boot, and improving control of a ski by using such as the edge.

The ski boots of this invention are formed by being provided with an inner boot fitted into an outer shell, placing externally of the inner boot an adjusting bolt inside of the fore part of the instep of said outer shell to be turnable freely, connecting a moving member to the adjusting bolt, placing between the outer shell and the inner boot pressing bands which are flexible and press the fore part of the foot instep in the width direction of the instep, fixing one end of each of the pressing bands to said outer shell, and coupling the other end of each of the pressing bands to said moving member, wherein approximately the center part of the rocking member is attached to the above moving member so as to be able to rotate, one end of each of the above pressing bands in a plural number is fixed to the rocking member at a predetermined distance from the other such pressing band ends, and the other end of each of them is fixed in spaced relation relative to each other to the above outer shell at a predetermined distance from the rocking member.

In the ski boots of this invention, the adjusting bolt is turned externally to apply a tensile force to the pressing bands, and the rocking member is rocked in the axis direction of the pressing bands depending on various foot shapes, thereby applying almost equal tensile force to the above plurality of pressing bands to press the fore part of the foot instep equally and thus more comfortably than boots using a single band.

DESCRIPTION OF THE PREFERRED EMBODIMENT

Figure 1:
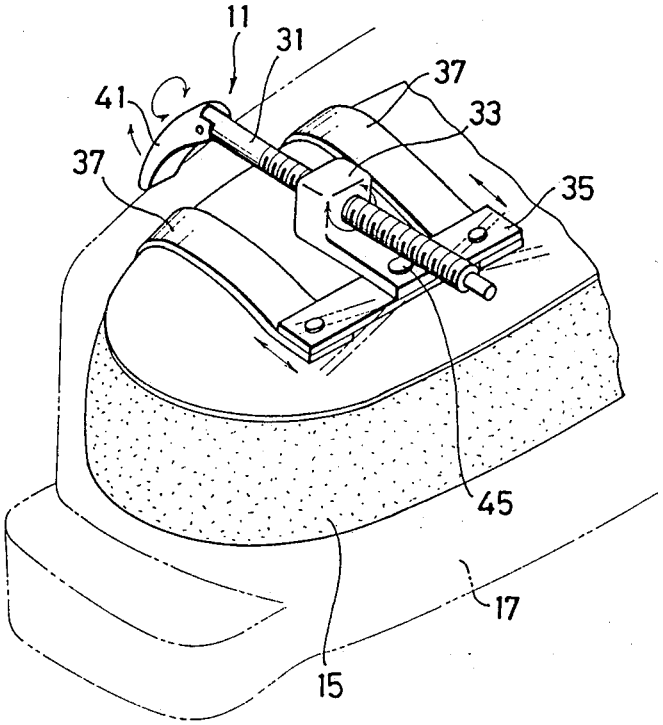
FIG. 1 is a perspective view showing a foot holding mechanism of a ski boot of one embodiment of the ski boot of the present invention.

The details of the invention will be described with reference to the embodiments shown in the drawings.

Figure 10:
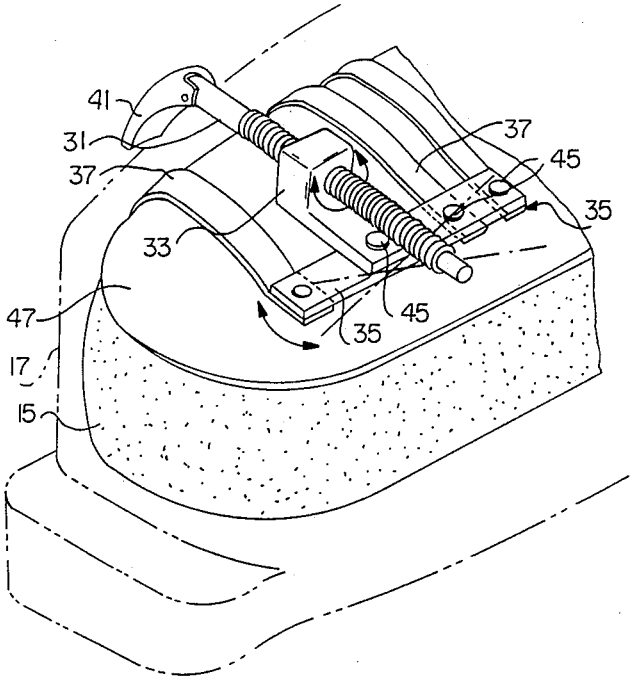
FIG. 10 is a perspective view showing the foot holding mechanism of the ski boot of FIG. 7.
Figure 11:
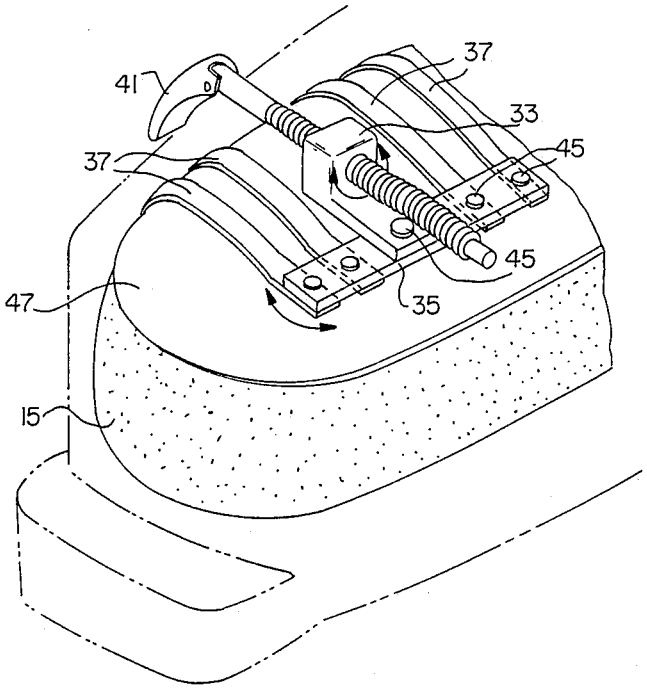
FIG. 11 is a perspective view showing a foot holding mechanism of a further embodiment of the ski boot of the present invention.

FIG. 1 illustrates the fore part of an instep which is one embodiment of the ski boots of this invention (alternative embodiments are illustrated in FIGS. 10 and 11), and the reference numeral 11 shows a foot holding mechanism to hold the fore part of the foot instep.

Figure 2:
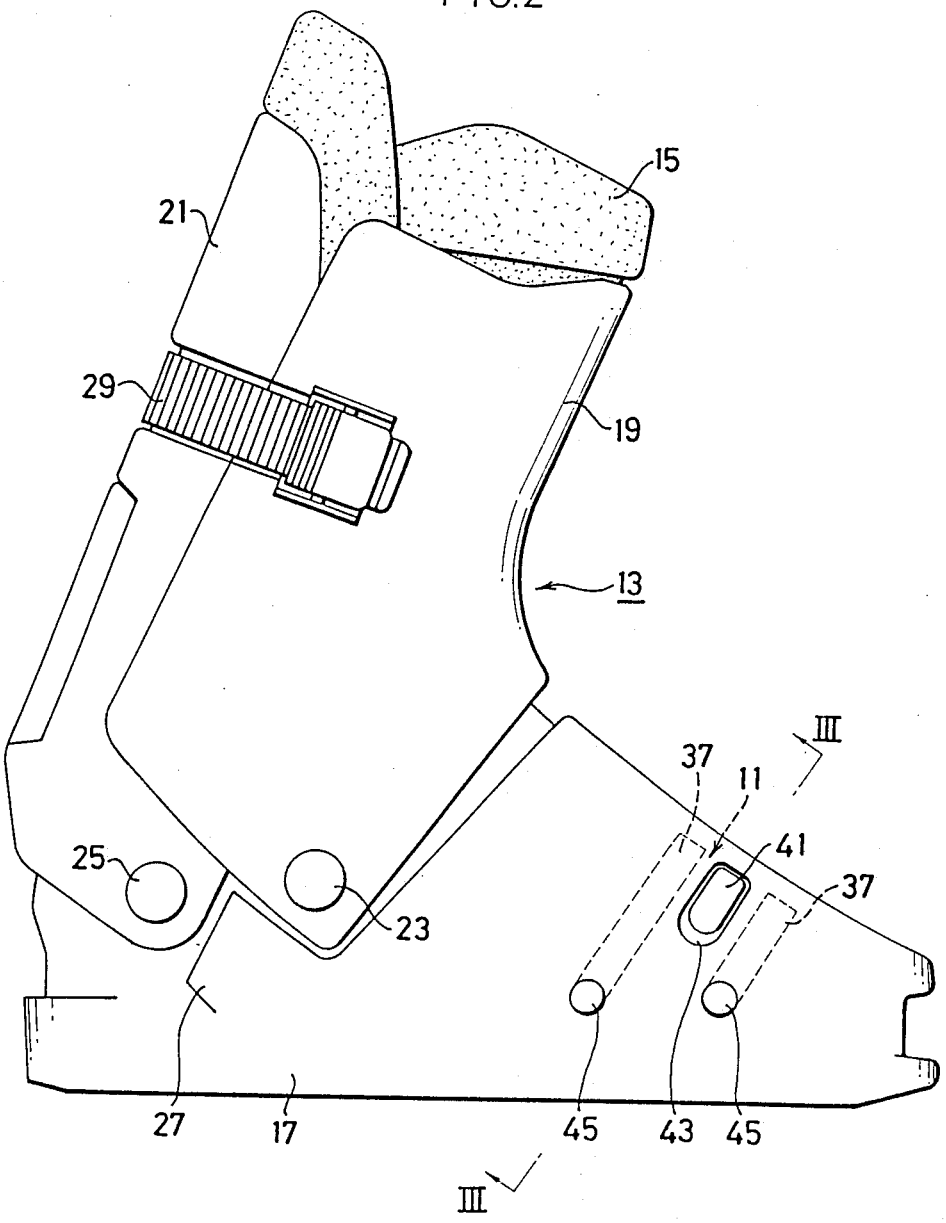
FIG. 2 is a side view showing the ski boot fitted with the foot holding mechanism of FIG. 1.
Figure 7:
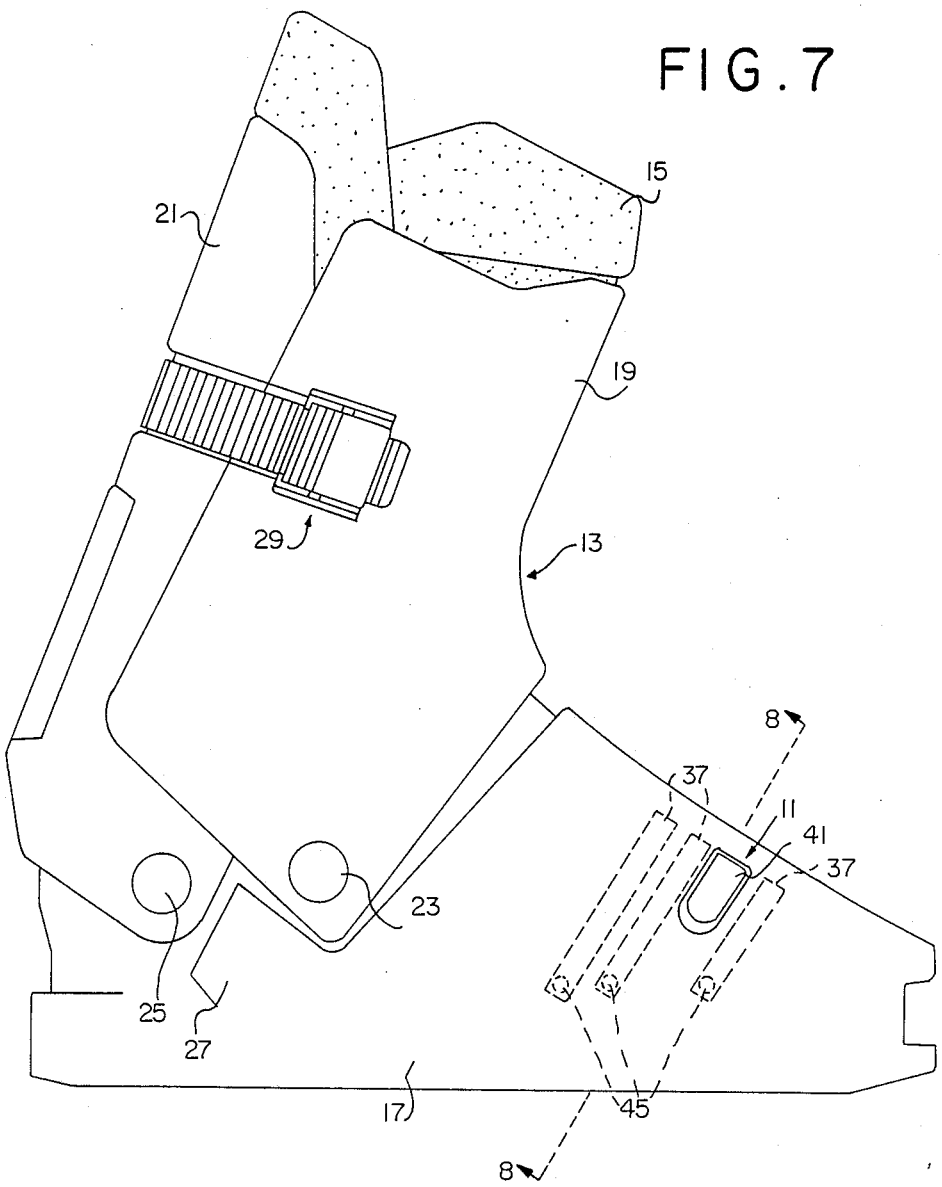
FIG. 7 is a side view of an alternative embodiment of the ski boot of the present invention fitted with an alternative foot holding mechanism.

As shown in FIG. 2, and in the alternative embodiment shown in FIG. 7 the ski boots with holding mechanism 11 are generally formed by being provided with an outer shell 13 which is made of synthetic resin rich in hardness and toughness and an inner boot 15 which is fitted in the outer shell 13.

The outer shell 13 consists of a shell body 17 covering mainly an ankle and its lower part, a front cuff 19 covering from an ankle part to a shin, and a rear cuff 21 covering from a top heel to a calf.

The lower end of the front cuff 19 is pivotably attached with a pin 23 to inner and outer ankle parts of the shell body 17 so as to be able to tilt forwardly, while the lower end of the rear cuff 21 is pivotably attached with a pin 25 to a heel covering part of the shell body 17 so as to be able to tilt backwardly.

A stopper 27 is formed on the shell body 17 to control the backward tilt movement of the front cuff 19.

Furthermore the front cuff 19 has an ankle tightener 29 to tighten and unite the front and rear cuffs 19 and 21.

And the foot holding mechanism 11 is installed, as shown in FIG. 1, in the fore part of the instep of the shell body 17.

Figure 9:
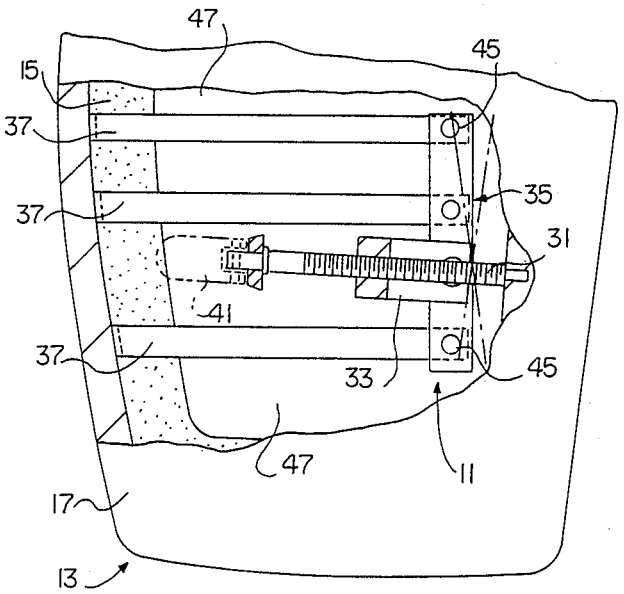
FIG. 9 is a partial cutaway top view showing the fore part of the instep of the shell body of FIG. 7.

This foot holding mechanism 11 consists of an adjusting bolt 31 which is placed inside the fore part of the instep of the shell body 17 to be rotatable externally, a moving member 33 which is connected to the adjusting bolt 31, a rocking member 35 whose central portion is attached to the moving member 33 to be turnable or rotatable freely, a plurality of pressing bands 37 which are flexible and placed between the shell body 17 and the inner boot 15. Two such pressing bands 37 are illustrated in FIGS. 1–4, depicting one embodiment of the present invention; three pressing bands 37 are depicted in FIGS. 7, 9 and 10, illustrating a further embodiment, and four such bands 37 are show in FIG. 11, illustrating a still further embodiment of the present invention.

Figure 3:
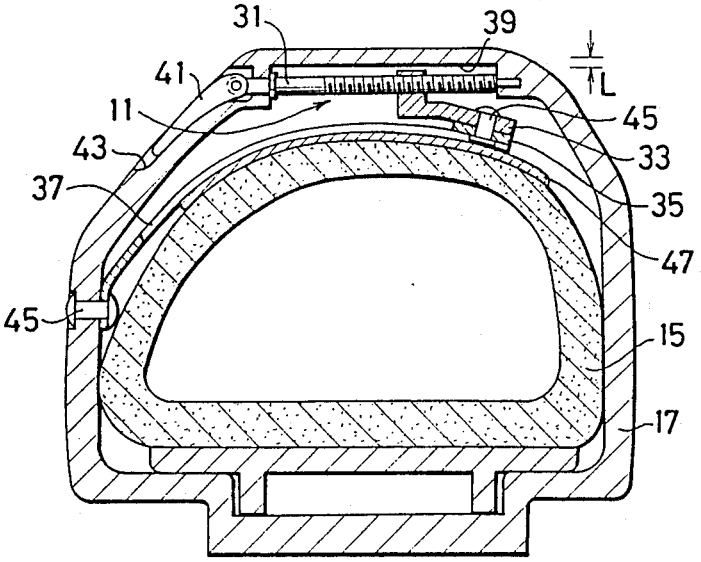
FIG. 3 is a transverse sectional view taken on line III—III of FIG. 2.
Figure 8:
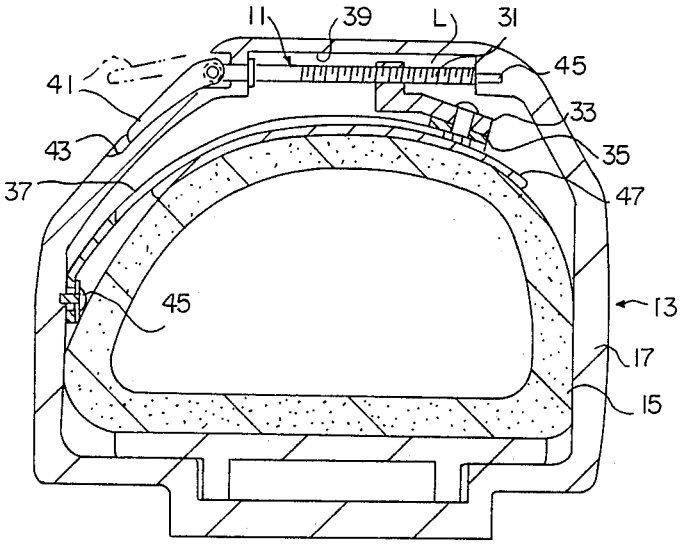
FIG. 8 is a transverse sectional view taken on line 8—8 of FIG. 7.

The adjusting bolt 31 is housed with its both ends freely turnable in a concave region 39 in the inner surface of the instep of the shell body 17 as shown in FIGS. 3 and 8. One end of this adjusting bolt 31 is extended externally to penetrate the shell body 17. An adjusting lever 41 is installed at the end of the adjusting bolt 31 which is penetrated through the shell body 17 so as to be freely turnable. The adjusting lever 41 is folded to be housed in a lever housing concave 43 formed in the outer surface of the shell body 17 so as not to project outside.

And a moving member 33 is formed in the shape of L to be connected to the adjusting bolt 31. There is formed a space L between the inner surface of the concave 39 where the adjusting bolt 31 is housed and the upper end of the moving member 33, so that the moving member 33 can turn at a given angle around the adjusting bolt 31 as its center.

Furthermore, for example, the central portion of the rocking member 35 which is made of a metallic band is attached with a rivet 45 at the lower end of the moving member 33 to be turnable.

As shown in FIGS. 1, 4, 10 and 11, for example, one end of each pressing band 37 made of resin is attached with a rivet 45 to the both end of rocking member 35 so as to be rotatable, while the other end is likewise attached to the outer side surface of the shell body 17 with a rivet 45.

And a holding plate 47 made of resin is inserted between the pressing bands 37 and the inner boot 15 to prevent the inner boot 15 from breakage caused by sliding of the pressing bands 37.

In the ski boots designed as mentioned above, the foot holding mechanism 11 can be adjusted as follows. At first, a foot is inserted in the inner boot 15 and then the adjusting lever 41 is pulled out from concave lever housing 43.

Figure 4:
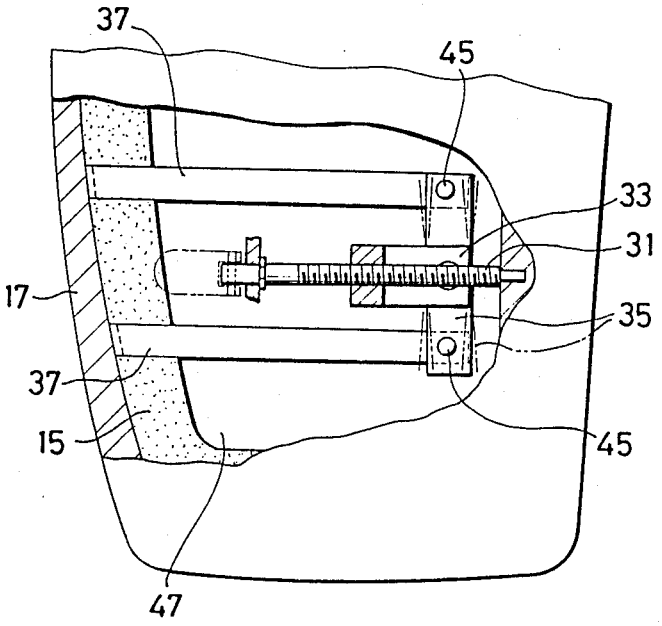
FIG. 4 is a partial cutaway top view showing the fore part of the instep of a shell body of FIG. 2.

And, when the adjusting lever 41 is turned in one direction, the moving member 33 which is connected to the adjusting bolt 31 moves toward the right side, thereby applying a tensile force to the pressing bands 37, as shown by two-dot and lines in FIG. 4 and by one dot and lines in FIG. 9, and rocking the rocking member 35 in the axis direction of the pressing bands 37 almost equally depending on various shapes of a foot to press the fore part of the foot instep.

When the moving member 33 is turned at a given angle around the adjusting bolt 31 as its center, the rocking member 35 which is rotatably attached to the moving member 33 rocks as shown for example by one dot and lines in FIG. 10 and by two dots and lines in FIG. 1. The pressing bands 37 move up and down depending on various shapes of a foot, thereby pressing the forward instep almost equally.

In such ski boots configured as mentioned above, the moving member 33 is connected to the adjusting bolt 31 to be turnable at a given angle around it, the central portion of the rocking member 35 is rotatably attached to the moving member 33, one end of each of two of the pressing bands 37 are attached respectively to the both ends of the rocking member 35 so as to be able to turn or rotate, and the other end of each of these pressing bands 37 is fixed to the shell body 17. Therefore the rocking member 35 is rocked in the width and height directions of the instep of the shell body 17 to change the shape of pressing bands 37 depending on various shapes of a foot, applying almost equal tensile forces to pressing bands 37, which sufficiently tightens the fore part of the instep so as to secure the foot to the inner boot 15 and thereby to the shell body 17, thereby giving a feeling of unity between the foot and the boot and improving the control of ski by using such as the edge.

The fore part of the foot instep is pressed and secured to the shell body 17 by at least two pressing bands 37 so as to be able to tighten the entire fore part of the instep almost equally so as not to hurt the foot. And the two pressing bands can fit to the fore part of the foot instep to tighten it to the shell body 17, thereby pressing to secure the foot.

Figure 5:
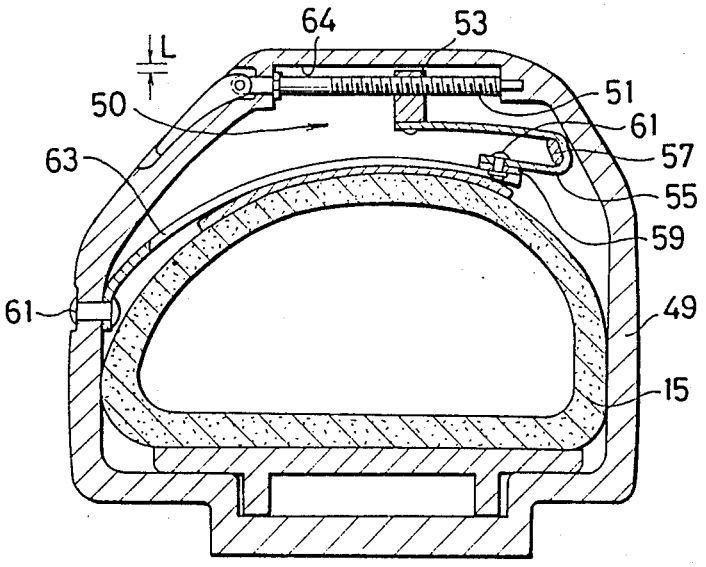
FIG. 5 is a transverse sectional view of the fore part of the instep of the shell body showing another embodiment of the foot holding mechanism of the ski boot of the present invention.

FIG. 5 illustrates the fore part of the instep of another embodiment of the ski boots of the present invention. In the drawing, a foot holding mechanism 50 is installed in a shell body 49, one end of a string-like (or elongated) connecting member 55 is fixed to a moving member 53 which is connected to an adjusting bolt 51 of the foot holding mechanism, the other end of the connecting member 55 is rotatably secured to the center of a rocking member 59 with a rivet 61 through a hook 57 which is formed in the shell 49. One end of two pressing bands 63 is rotatably secured with the rivet 61 respectively to both ends of the rocking member 59. The other end of these pressing bands 63 is fixed respectively to the shell body 49 with the rivet 61. There is formed a space L between the inner surface of a concave 64 where an adjusting bolt 51 is housed and the top end of the moving member 53, so that the moving member 53 can turn at a given angle around the adjusting bolt 51 as its center.

Such ski boots as mentioned above in regard to FIG. 5 can provide the same effect as the ski boots of FIGS. 1 and 7.

Figure 6:
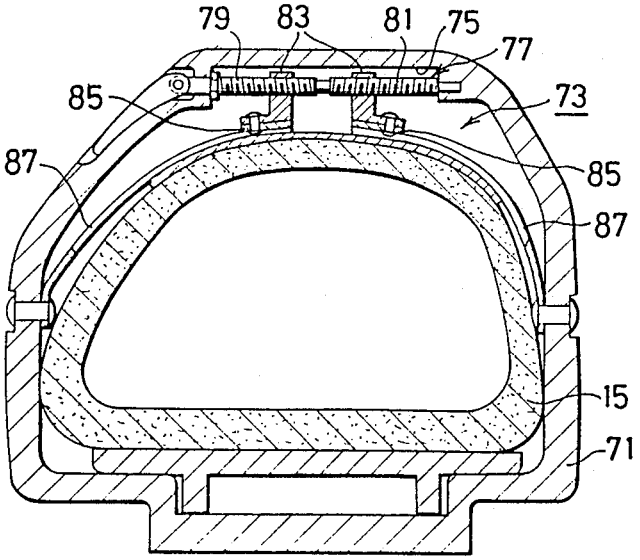
FIG. 6 is a transverse sectional view of the fore part of the instep of the shell body showing an additional embodiment of the ski boot of the present invention.

FIG. 6 illustrates the fore part of the instep of an additional embodiment of the ski boots of the present invention.

In the drawing, a foot holding mechanism 73 which is installed in a shell body 71 consists of an adjusting bolt 77 which is housed with each of its ends attached so as to be freely turnable in a concave region 75 formed in the inner surface of the instep of the shell body 71, two moving members 83 which are connected to left and right threads 79 and 81 respectively formed in the both ends of this adjusting bolt 77, rocking members 85 which are fixed respectively to these moving members 83, and four pressing bands 87 whose one end is turnably fixed respectively to these rocking members 85 and other ends are fixed to the shell body 71, two ends to its outer side and the other two to the inner side.

There is formed a space L between the inner surface of the concave region 75 where the adjusting bolt 77 is housed and the top end of the moving members 83, so that the moving members 83 can turn at a given angle around the adjusting bolt 77 as its center.

In the ski boots formed as mentioned above, turning the adjusting bolt 77 in one direction allows two moving members 83 to move to approach each other and through the rocking members 85 which are rotatably attached respectively to moving members 83, a tensile force is applied to the pressing bands 87 which are rotatably attached to rocking members 85, at least two pressing bands 87 to each rocking member 85, such that the fore part of the foot instep is pressed from both sides.

Such ski boots designed as mentioned above in regard to FIG. 6 can provide the same effect as the embodiments of ski boots shown in FIGS. 1 and 7. Furthermore, in a condition that the fore part of the foot instep is pressed equally from both sides of the shell body 71 so as to fit the boot, the fore part of the foot instep can be tightened sufficiently by the pressing bands 87 and pressed to be secured against the shell body 71, thereby improving the feeling of unity between the foot and the ski boot.

The above embodiments show examples such that if two pressing bands 37, 63, 87 are fixed to one rocking member 35, 59, 85. The present invention, however, is not so limited. When, for example, four pressing bands 37, 63, 87 are fixed to the one rocking member 35, 59, 85, and press and secure the fore part of the foot instep, the present invention can provide the same effect as above, with two pressing bands.

And, the above embodiments show for another example that one end of the pressing bands 37, 63, 87 are fixed to the side surface of the shell body 17, 49, 71. The present invention, however, is not limited to the above embodiment. For example, fixing one end of the pressing bands 37, 63, 87 to the bottom surface of the shell body 17, 49, 71 can provide almost the same effect as the above embodiment. Furthermore a pressing force generated by the pressing bands 37, 63, 87 applies to a foot entirely, so that the foot can be tightened more sufficiently.

Additionally, the above embodiment shows an example that the foot holding mechanism 11, 50, 73 is installed in a rear-entry-type ski boots which the rear cuff 21 is opened backwardly. The present invention, however, is not limited to the above embodiment. That is, for example, foot holding mechanism 11, 50, 73 may be installed in ski boots in which the front cuff 19 is opened forwardly.

What is claimed is:

1. Ski boots formed by being provided with an outer shell and an inner boot fitted into it, comprising an adjusting bolt within the fore part of the instep of said outer shell to be freely turnable externally, a moving member connected to the adjusting bolt, there being between said outer shell and said inner boot a plurality of pressing bands which are flexible and press the fore part of the foot instep in the width direction of the instep, one end of each of the pressing bands being fixed to said outer shell, the other end of each of the pressing bands being coupled to said moving member, wherein about a central portion of a rocking member having two ends is rotatably attached to the above moving member, one end of each of the above plurality of pressing bands being rotatably attached to the rocking member at a predetermined distance from the other pressing band ends and the other end of each of the bands being fixed spacedly relative to each other to the outer shell at a predetermined distance from the rocking member, one said pressing band being rotatable attached at each of said rocking member ends.

2. Ski boots as claimed in claim 1, in which the moving member is connected to the adjusting bolt so as to be turnable at a given angle around the adjusting bolt as its center, and one end or each of two of the pressing bands is rotatably attached respectively to each end of the rocking member which is rotatably attached to the moving member, and the other end of each of the pressing bands is fixed to the shell body at a predetermined distance from the rocking member.

3. Ski boots as claimed in claim 1, in which one end of an elongated string-like connecting member is fixed to said moving member, and the other end of the connecting member is rotatably attached to the center of the rocking member through a hook which is formed in the shell body.

4. Ski boots as claimed in claim 1, in which said adjusting bolt is formed with two threaded parts in different directions, two moving members are connected to each threaded part, the rocking member is fixed to each moving member, one end of each of a plurality of pressing bands is rotatably attached respectively to the rocking member, and the other end of each of the pressing bands is fixed respectively to the outer and inner side surfaces of the shell body.

5. Ski boots as claimed in claim 1, in which there is provided a space between the inner surface of the outer shell and the moving member, so that the moving member can turn at a given angle around the adjusting bolt as its approximate center.

6. Ski boots in accordance with claim 1, wherein said other ends of the pressing bands are fixed to a bottom surface of the shell body.

* * * * *

UNITED STATES PATENT AND TRADEMARK OFFICE

CERTIFICATE OF CORRECTION

PATENT NO. : 4,977,692

DATED : December 18, 1990

INVENTOR(S) : Iwama et al

It is certified that error appears in the above-identified patent and that said Letters Patent is hereby corrected as shown below:

In the title, please insert before "RETENTION" the word --FOREFOOT--.

Signed and Sealed this

Second Day of June, 1992

*Attest:*

DOUGLAS B. COMER

*Attesting Officer*

*Acting Commissioner of Patents and Trademarks*